United States Patent [19]

Lamos

[11] 4,318,539

[45] Mar. 9, 1982

[54] APPARATUS FOR AND METHOD OF COLLATING SORTING AND STACKING SHEETS CONCURRENTLY

[75] Inventor: Richard A. Lamos, Boulder, Colo.

[73] Assignee: International Business Machines Corporation, Armonk, N.Y.

[21] Appl. No.: 205,061

[22] Filed: Nov. 7, 1980

Related U.S. Application Data

[63] Continuation of Ser. No. 4,773, Jan. 19, 1979, abandoned, which is a continuation-in-part of Ser. No. 856,551, Dec. 1, 1977, abandoned.

[51] Int. Cl.[3] ..... B65H 39/06; B65H 29/58

[52] U.S. Cl. ..... 270/58; 271/207; 271/212; 271/217; 271/287; 414/29; 414/54

[58] Field of Search ..... 270/54–58; 414/54, 62, 63; 271/64, 297, 207, 212, 217, 239, 254, 314, 302, 303, 287; 493/374

[56] References Cited

U.S. PATENT DOCUMENTS

| | | | |
|---|---|---|---|
| 2,919,917 | 1/1960 | Worswick | 271/297 |
| 3,735,978 | 5/1973 | Turner | 271/88 |
| 3,744,790 | 7/1973 | Hoffman | 271/64 |
| 3,774,902 | 11/1973 | Schulze | 270/58 |
| 3,964,741 | 6/1976 | Kroeker | 271/213 |
| 4,072,304 | 2/1978 | Brown | 270/58 |

*Primary Examiner*—Steven A. Bratlie
*Assistant Examiner*—A. Heinz
*Attorney, Agent, or Firm*—Joscelyn G. Cockburn; John H. Holcombe

[57] ABSTRACT

An apparatus for and a novel method of collating, sorting and stacking sheets, concurrently termed "offset collation", are disclosed. The first sheets of sets to be collated, numbering up to the desired number of sets in a job, are transported from an entry station to a unitary bin sheet receiving station via a sheet transport station having an arcuate feed path to and through the aforementioned unitary bin sheet receiving station. These first sheets are stacked in the unitary bin sheet receiving station in an alternate offset fashion clearly demarcating the sets to be collated. The second sheets of the aforementioned sets are then sequentially inserted in the same alternate offset fashion contiguous to the first sheets. The method is repeated until all the sheets comprising a set have been inserted into all the sets. The final result is collated, sorted and stacked sets readied for convenient removal from the unitary bin sheet receiving station.

30 Claims, 15 Drawing Figures

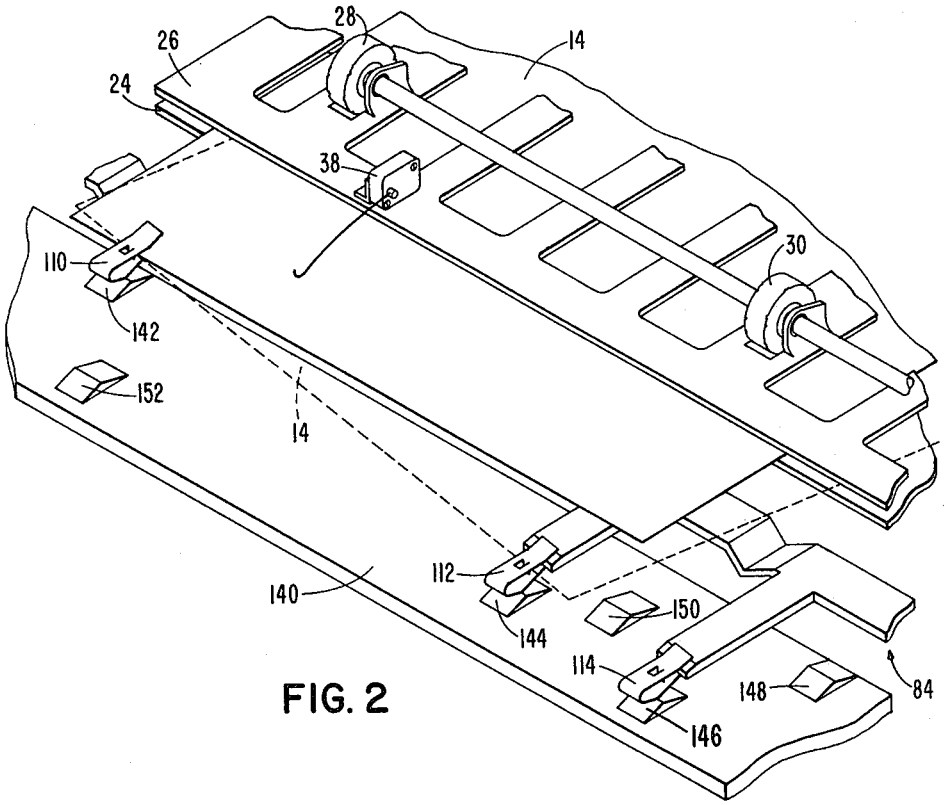
FIG. 2
FIG. 5
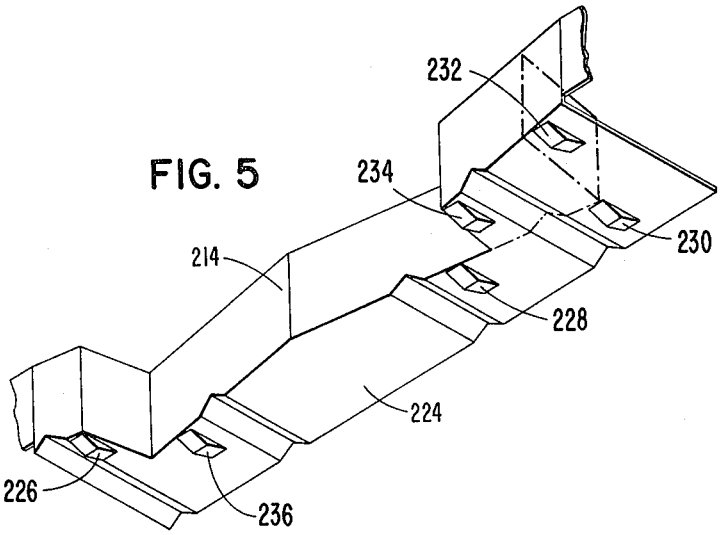

APPARATUS FOR AND METHOD OF COLLATING SORTING AND STACKING SHEETS CONCURRENTLY

This application is a continuation of application Ser. No. 004,773, filed Jan. 19, 1979, now abandoned, which is a continuation-in-part of application Ser. No. 856,551, filed Dec. 1, 1977, now abandoned.

BACKGROUND OF THE INVENTION

1. Field of the Invention

This invention relates to an apparatus for and a method of collating, sorting and stacking sheets, and more particularly, to the method of "offset collation" using an "offset collator".

2. Description of the Prior Art

The terms "collate" and "sort" have at times been used interchangably in the prior art. Accordingly, so that the description herein-to-follow is clearly understood, some definitions are in order.

To "collate" is to arrange or assemble according to an orderly system of classification, e.g., by page number or order of sheets. Thus, "collating", as the term is used herein, is integrating sheets by classification, and in the case of "collation" the classification generally is by page number. Consequently, "collation" is the act or process of "collating", and a "collator" is an apparatus for so doing.

To form a "set" is to group by classification. Thus, the end product of "collation" is a plurality of "sets."

To "sort" is to put in a given place or rank according to kind or class, e.g., by stacking "sets" and/or placing them such that each is demarcated from the other so as to be easily identified and handled. Thus, "sorting", as the term is used herein, is segregating by "sets." Consequently, "sortation" is the act or process of "sorting", and a "sorter" is an apparatus for so doing.

As far as is known, prior art collators have been derived, or based on two methods of collation. These methods or processes are commonly termed "online collation" and "offline collation".

In collators using the online collation technique, all of the first sheets of a multipage document are produced and transported, one each, to a plurality of discrete bins. Then, all of the second sheets of the multipage document are produced and transported, one each, to the aforementioned plurality of discrete bins. This process is repeated until sets (one each) are built up in the plurality of discrete bins. Generally, collators of this type are designed to interface with an associated copier, duplicator, printer, or like machine. As a consequence, these collators become an integral part of the associated reproduction machine adding to the already substantial overall size thereof.

The size of online collators and offline collators (to be discussed hereinafter) is directly dependent on the number of discrete bins and the physical dimensions thereof. Generally, the number of discrete bins determines the maximum number of sets that can be run in a particular job. The physical dimensions of the discrete bins, characterized by their height, width and depth determine the maximum sheet size that can be processed and the maximum number of sheets per discrete bin.

Since there is an overall physical size limitation, the solution in the prior art machines has been to strike a balance between the maximum number of sets that can be run in a job and the maximum number of sheets that can comprise a set. Thus, in order to meet the physical size requirement, typical prior art machines have a capacity of 20 sets comprising 100 sheets each giving a total sheet capacity of 2,000.

Consequently, the prior art solution to the physical size problem, generally, has been to limit the overall physical size of collators by limiting the total sheet capacity. Nevertheless, machines in the prior art are still large and bulky when compared with their associated reproduction machines.

Thus, there is a need in the prior art for a collator of the online type, i.e., integral with an associated reproduction machine, that has a total sheet capacity of typical prior art collators but yet is smaller in physical size than heretofore realizable.

Still referring to online collators, there is a built-in operator inconvenience and increased cost in unloading these collators. For example, for a 20 bin collator, which is loaded to capacity, 20 separate motions are required, by an operator or other means, to unload, and for those collators not having automatic stapling and/or unloading, the operator will have to take care not to mix the sets by either stapling each set as it is removed, or by stacking the sets, offset from one another, to clearly demarcate them. It is clear that the foregoing actions and cautions, manually or otherwise, are time consuming, wasteful and expensive.

Thus, there is a need in the prior art for a collator of the online type having a capacity of the typical prior art collators that does not require unloading, in the prior art sense, and that provides not only collated sets but sorted and stacked sets readied for convenient removal, manually or otherwise, in a single motion rather than several motions.

It is realized that prior art collators of the online type will suffice for most job requirements in a typical office environment. However, there are job requirements that cannot be satisfied by a collator having a plurality of discrete bins, and, for example, a maximum set capacity of 20 and a maximum sheet capacity of 100 sheets per set giving a total sheet capacity of 2,000.

In a typical office environment, there are jobs that require the number of sets to be more than 20, but rarely require more than 100 sheets per set. Thus, prior art online collators have limitations in job flexibility characterized by the number of discrete bins and the sheet capacity of each bin.

As a consequence, there is a need in the prior art for an online collator having substantially infinite job flexibility limited only by the total number of sheets in a job rather than the total number of sets in a job, or the total number of sheets in a set.

As previously mentioned, there is another well known technique of collating, termed "offline collation" wherein the collators derived therefrom are generally complete within themselves. Since these collators are not designed to operate and interface with a host reproduction machine, they are generally larger in size, and, accordingly have more discrete bins and more sheets per bin capacity than online collators.

Using the offline collation technique, the general procedure is to produce from a multipage document, all of pages 1, then all of pages 2 and so forth. Then, a sorter is generally used to sort and stack like pages by jogging the sets to demarcate between the pages 1, the pages 2 and so forth. The sheets are then taken, or transported to the offline collator whereat all of the pages 1 are put into a bin, and all of the pages 2 are put into another bin and so forth. Finally, the offline collator operates to take pages out of each of the bins to make a collated set. The process is continued until the desired number of sets have been made.

In order to acquire the additional sheet capacity possible with offline collators, the aforementioned inconveniences are contended with in the special applications warranting the use of such a collator. Nevertheless, this collation technique is still limited to the number of discrete bins in the collator. Thus, the total sets in a job generally cannot comprise more pages of a like kind than there are discrete bins.

Hence, there is a need in the prior art for an offline collator having substantially infinite job flexibility limited only by the total number of sheets in a job rather than the total number of sets in a job, or the total number of sheets in a set, and at the same time be smaller in physical size than prior art offline collators with compatible total sheet capacity.

OBJECTS OF THE INVENTION

Accordingly, an important object of the present invention is to collate, sort and stack sheets concurrently using a "unibin" offset collator.

A further object of the present invention is to reduce the physical size of online and offline collators without compromising the total sheet handling capacity thereof.

Yet another object of the present invention is to substantially increase job flexibility in online and offline collators, job flexibility being limited only by the total number of sheets in a job rather than the total number of sets in a job, or the total number of sheets in a set.

Still another object of the present invention is to eliminate the necessity of multiple and separate motions by an operator or other means to unload online collators and offline collators, but requiring instead only a single motion, manually or otherwise, to unload.

SUMMARY OF THE INVENTION

The apparatus for and method of collating, sorting and stacking sheets concurrently, according to the invention, by which these and other objects, features and advantages are accomplished are characterized by a "unibin" offset collator having a unitary bin sheet receiving station for receiving and supporting the aforesaid sheets in such a way that collated, sorted and stacked sets therein are readied for convenient removal therefrom.

The apparatus, according to the invention, operates so that from a sheet entry station the sheets are fed to an arcuate sheet transport station which forms an arcuate sheet transport path from the sheet entry station to and through the unitary bin sheet receiving station. Included in the arcuate sheet transport station are a plurality of sheet grippers for gripping, positioning and transporting sheets, to be collated, sorted and stacked into sets, in an alternate offset fashion to the unitary bin sheet receiving station, aforementioned. As a consequence, the first sheets, e.g., all of the pages 1 of a multipage document, are transported to the "unibin" of the unitary bin sheet receiving station and inserted therein in the aforementioned alternate offset fashion. Also a reciprocating sheet separator support mechanism is disposed adjacent to the "unibin" and cooperates therewith to cause proper sequential insertion of the sheets therein, thereby forming the collated, sorted and stacked sets.

The method, according to the invention, embodies the novel concept of "offset collation". In offset collation, the first sheets, e.g., all of the pages 1 of a multipage document, of sets to be collated—and as an outgrowth of the method, sorted and stacked—numbering up to the number of sets desired, are inserted and stacked in the "unibin" of the unitary bin sheet receiving station, each of the first sheets being alternatively offset from each other clearly demarcating the sets to be collated. Then, the second sheets are sequentially inserted contiguous to the first sheets. The method is repeated until all the sheets comprising a set have been inserted into all the sets. The final result is collated, sorted and stacked sets readied for convenient removal from the "unibin".

BRIEF DESCRIPTION OF THE DRAWINGS

The foregoing and other objects, novel features and advantages of the invention will be apparent from the following more particular description of the preferred embodiment as illustrated in the accompanying drawings, in which:

FIG. 2 is a segmented perspective view of the apparatus according to the invention, depicting how sheets are gripped and skewed in the offset fashion;

FIG. 5 is a segmented perspective view of the apparatus, according to the invention, showing how a sheet is released from a sheet gripper into the "unibin" of the unitary bin sheet receiving station;

Figure 8:
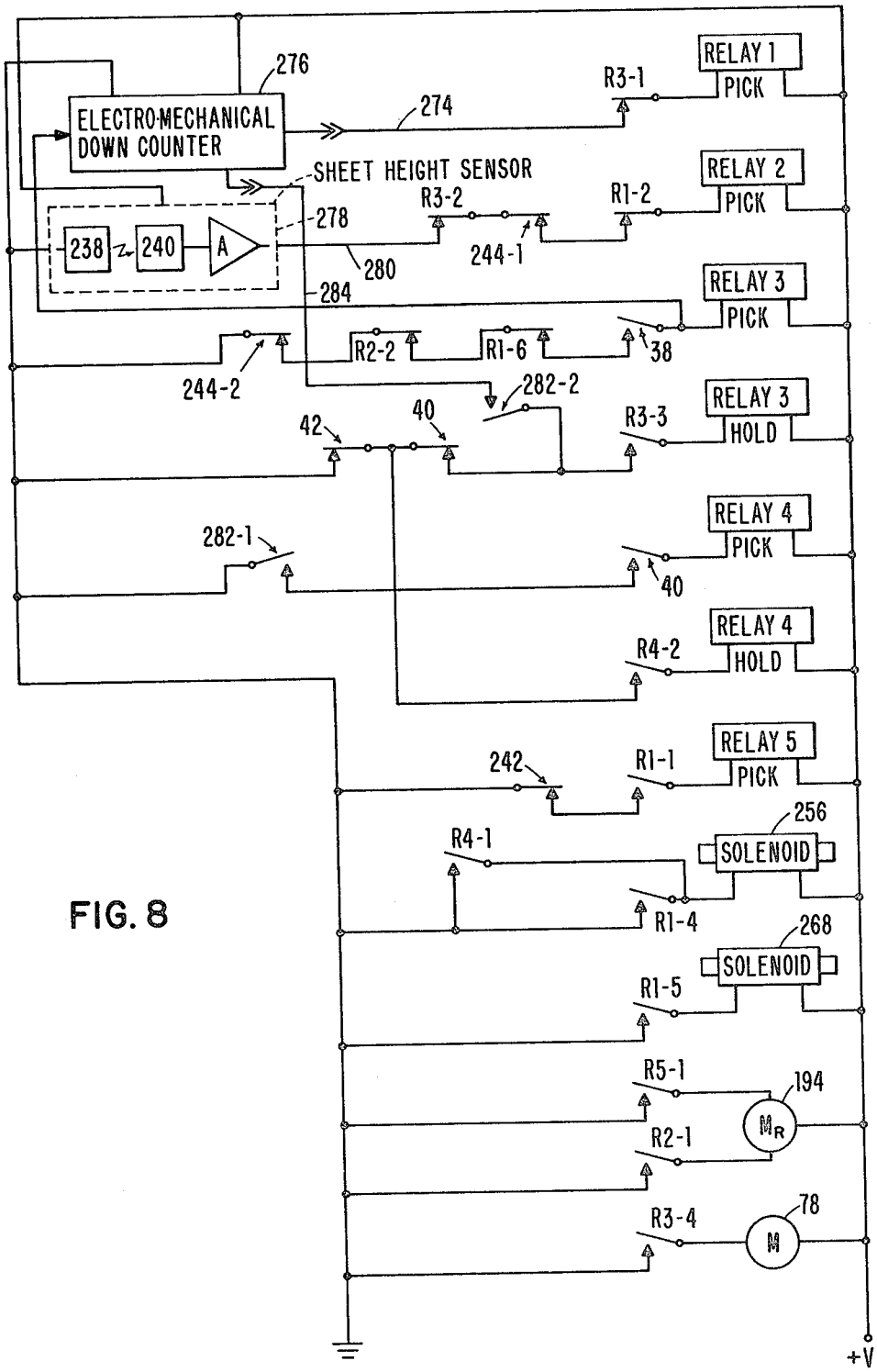
Figure 9:
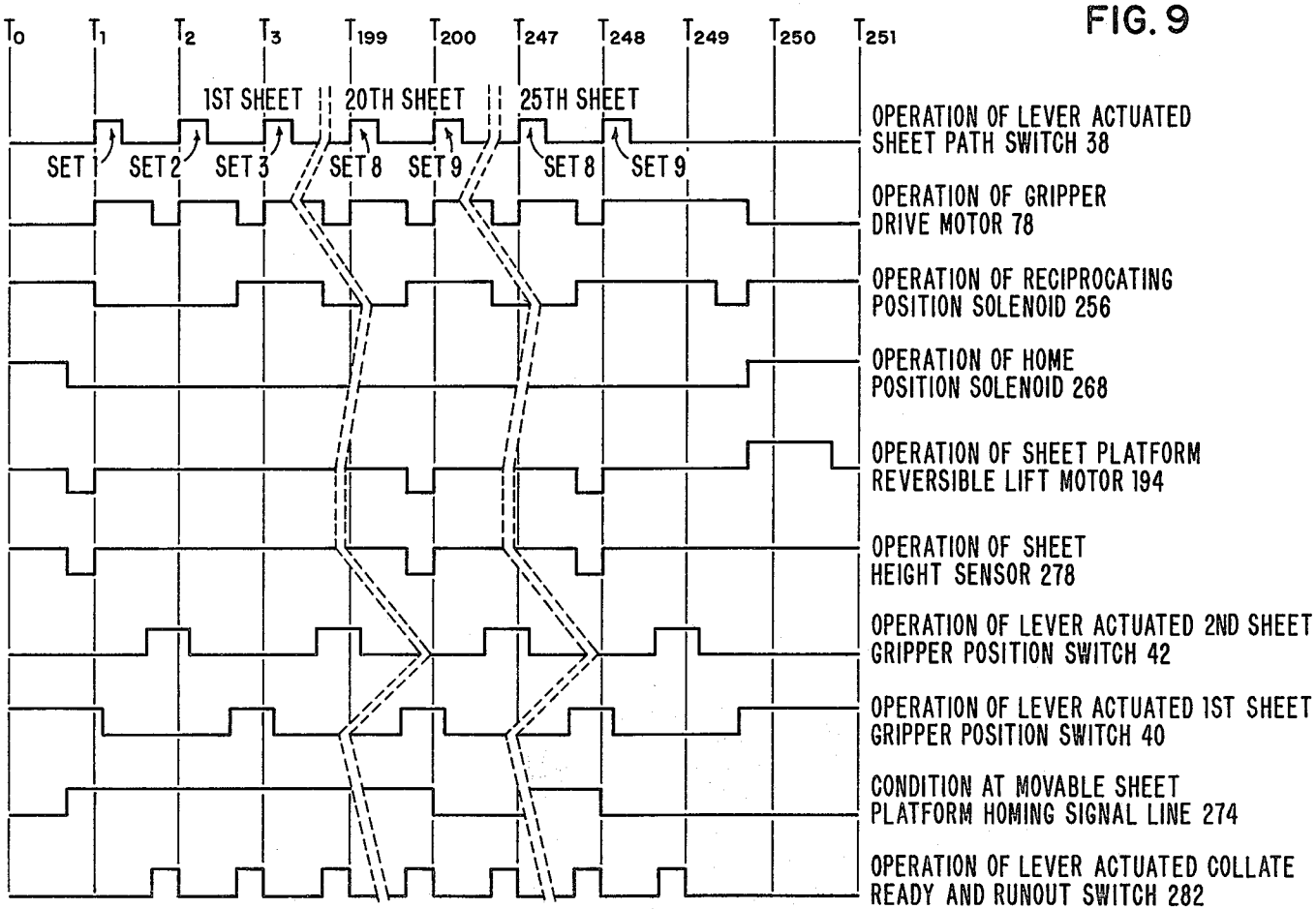

FIGS. *6a* and *6b* show segmented plan views, inter alia, of the reciprocating sheet separator support mechanism according to the invention;

FIGS. *7a* through *7f* illustrate the method of "offset collation", according to the invention, and illustrate, by example, the processing of a job comprising 9 sets having 25 sheets each;

FIG. 8 is a circuit diagram of the control logic according to the invention; and FIG. 9 is a timing diagram illustrating the sequential inter-relationship of the various elements, according to the invention, during the processing of the job illustrated in FIGS. *7a* through *7f*.

DESCRIPTION OF THE PREFERRED EMBODIMENT

The following is a description, according to the invention, of the apparatus for and the method of collating, sorting and stacking sheets concurrently. The operation of the apparatus, according to the invention, is described and explained hereinafter under the heading "Statement of the Operation".

Figure 1:
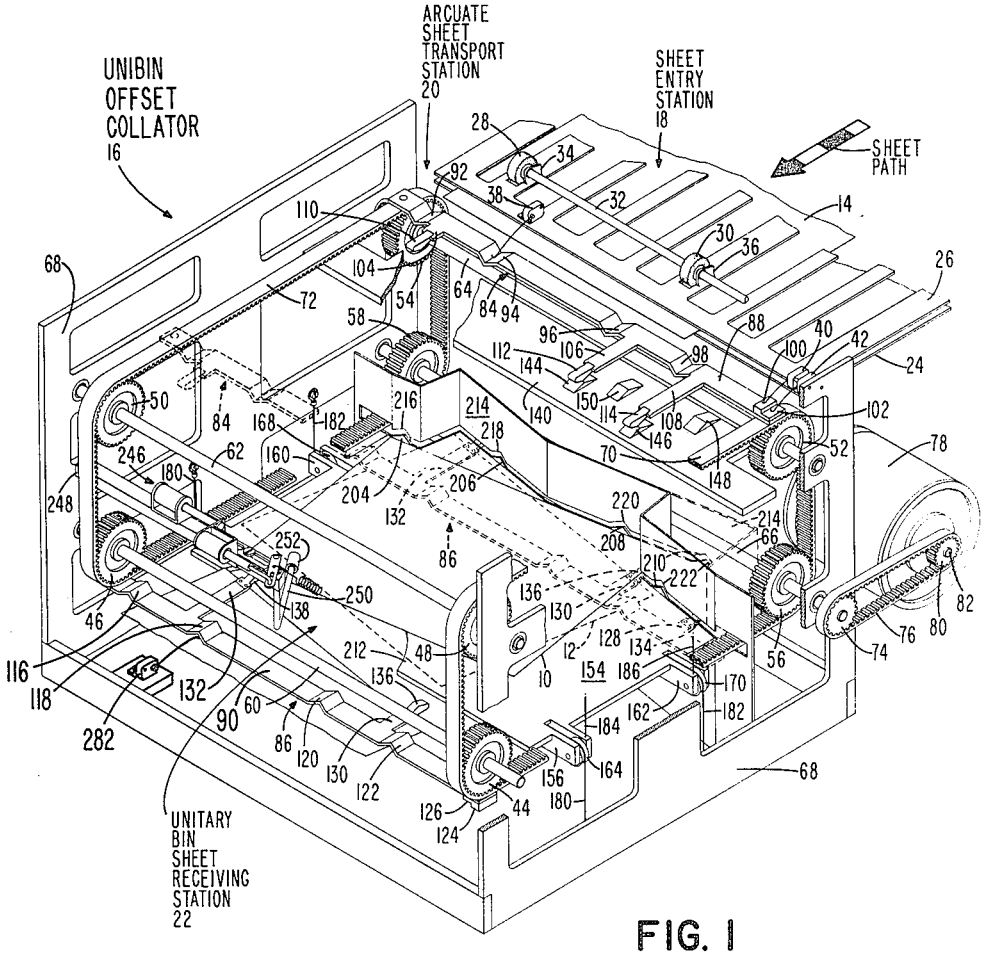
FIG. 1 is a perspective view of the apparatus, according to the invention, showing inter alia, the principal elements thereof.

Referring now to FIG. 1, first, second and third sheets 10, 12 and 14, respectively, are shown processed or being processed in "unibin" offset collator 16 which comprises sheet entry station 18, arcuate sheet transport station 20 and unitary bin sheet receiving station 22.

Sheet entry station 18 is a mechanism that can be easily interfaced with the sheet exit area of a copier, duplicator, printer or like machine, if "unibin" offset collator 16 is to be used as an offline collator, sheet entry station 18 can be interfaced with any well known sequential sheet feeder.

Still referring to FIG. 1, sheet entry station 18 comprises, inter alia, lower sheet guide 24 and upper sheet guide 26. A pair of low friction urging rollers 28 and 30 are fixedly connected to urging roller shaft 32 which, in turn, is journaled to urging roller shaft tabs 34 and 36 integral to upper sheet guide 26, aforementioned. Urging roller shaft 32 is operatively coupled to a motor (not shown) for supplying sufficient driving force thereto, and accordingly, to low friction urging rollers 28 and 30 for feeding a sheet, for example, third sheet 14, to arcuate sheet transport station 20. Mounted to the top surface of upper sheet guide 26 is lever actuated sheet path switch 38 for detecting the presence or absence of a sheet at arcuate sheet transport station 20. Also, mounted to the top surface of upper sheet guide 26 are lever actuated first and second sheet gripper position switches 40 and 42, for detecting, respectively, either of two possible sheet transporting conditions. Details of the conditions will be discussed more fully in the "Statement of the Operation" herein-to-follow.

Continuing, and still referring to FIG. 1, arcuate sheet transport station 20, previously mentioned, comprises, inter alia, a plurality of gripper belt pulleys 44, 46, 48, 50, 52, 54, 56 and 58. The aforementioned pulleys, in pairs, are fixedly connected to a plurality of gripper belt pulley shafts 60, 62, 64 and gripper belt pulley drive shaft 66, respectively. Each of the aforementioned shafts are journaled to main support frame 68 and disposed so that when gripper transporting timing belts 70 and 72 are placed on gripper belt pulleys 44, 48, 52 and 56, and 46, 50, 54 and 58, respectively, the arcuate sheet path of arcuate sheet transport station 20 is formed thereby.

To continue with the description of arcuate sheet transport station 20 of "unibin" offset collator 16, fixedly connected to gripper belt pulley drive shaft 66 is drive shaft pulley 74. Gripper drive motor timing belt 76 couples drive shaft pulley 74 to gripper drive motor 78 via gripper drive motor pulley 80 fixedly connected to gripper drive motor shaft 82.

Also shown in FIG. 1 are first and second sheet grippers 84 and 86 each being fixedly connected to gripper transporting timing belts 70 and 72, and perpendicular to the sheet path, such that the aforementioned sheet grippers move therewith. In phantom line depiction are first and second sheet grippers 84 and 86 shown in a forward advanced position clearly illustrating the prior processing, in an alternate offset fashion, of first and second sheets 10 and 12 by first and second sheet grippers 84 and 86, respectively.

First and second sheet grippers 84 and 86 include first and second sheet gripper bars 88 and 90, respectively. First sheet gripper bar 88 includes a plurality of first sheet gripper bar serrated contours 92, 94, 96 and 98. Also, attached to first sheet gripper bar 88 is first sheet gripper bar elevated contour 100 for actuating lever actuated first sheet gripper position switch 40, aforementioned, indicating thereby, the proper positioning of first sheet gripper 84 to receive a sheet to be transported as shown in FIG. 1. Additionally, attached to first sheet gripper bar 88 is first sheet gripper bar recessed contour 102 which operates to maintain lever actuated second sheet gripper position switch 42, aforementioned, deactuated. Accordingly, the combination of the two aforementioned switch conditions indicates to the system control logic circuitry the proper position of first sheet gripper 84 for the feeding of a sheet thereto.

Integral and perpendicular to first sheet gripper bar 88 are a plurality of first sheet gripper arms 104, 106 and 108, each respectively longer in length. Fixedly connected, respectively to each of the aforementioned first sheet gripper arms, are a plurality of first sheet gripper clips 110, 112 and 114.

Likewise, second sheet gripper bar 90 includes a plurality of second sheet gripper bar serrated contours 116, 118, 120 and 122. Also, attached to second sheet gripper bar 90 is second sheet gripper bar elevated contour 124 for actuating lever actuated second sheet gripper position switch 42, aforementioned. Additionally, attached to second sheet gripper bar 90 is second sheet gripper bar recessed contour 126 which operates to maintain lever actuated first sheet gripper position switch 40 deactuated. Thus, the combination of the two aforementioned switch conditions indicates to the system control logic the proper position of second sheet gripper 86 for receiving a sheet.

Second sheet gripper bar 90 further includes a plurality of second sheet gripper arms 128, 130, and 132 integral and perpendicular thereto, each of the aforementioned second sheet gripper arms, respectively, and progressively, having longer lengths in contradistinction to the aforementioned first sheet gripper arms. Fixedly connected, respectively, to each of the aforementioned second sheet gripper arms is a plurality of second sheet gripper clips 134, 136 and 138.

Mounted to main support frame 68 and disposed in the sheet path is lever actuated collate ready and runout switch 282 for detecting the presence or absence of a sheet at the entrance to unitary bin sheet receiving station 22. More about the operation of the aforementioned switch is explained hereinafter under the heading "Statement of the Operation".

Referring now to FIGS. 1 and 2 concurrently, entry camming contour plate 140, fixedly attached to main support frame 68, has situated thereon a plurality of first sheet gripper entry camming contours 142, 144 and 146 for camming open first sheet gripper clips 110, 112 and 114, respectively and simultaneously, in order to grip a sheet to be processed. Similarly, a plurality of second sheet gripper entry camming contours 148, 150 and 152 also situated on entry camming contour plate 140 operate to cam open second sheet gripper clips 134, 136 and 138, respectively and simulatenously, in order to grip a subsequent sheet to be processed.

Still referring to FIGS. 1 and 2 concurrently, but primarily to FIG. 2, as a sheet, e.g., third sheet 14 makes lever actuated sheet path switch 38 and first sheet gripper 84 is at the home position, i.e., in a position to properly receive a sheet as indicated to the system control logic by the making of lever actuated first sheet gripper position switch 40, third sheet 14 is driven forward by low friction urging rollers 28 and 30. Now as shown in FIG. 2, first sheet gripper clips 110, 112 and 114 are cammed open as aforementioned. Thus, third sheet 14 is driven forward such that when the left side thereof contacts first sheet gripper clip 110 it is stopped thereby. Due to the low friction drive of low friction urging rollers 28 and 30, positive drive by low friction urging roller 28 stops while positive drive is continued by low friction urging roller 30. Accordingly, the right side of third sheet 14 is driven into and contacts first sheet gripper clip 112. The dotted outline of third sheet 14 depicts its skewed or offset position after the foregoing operation. It is clear that when first sheet gripper 84 moves forward first sheet gripper clips 110, 112 and 114 close firmly thereby gripping third sheet 14. As illustrated in FIG. 2, third sheet 14 is of a standard size, e.g., 8.5 inches by 11 inches. But as clearly shown, legal size, e.g., 8.5 inches by 14 inches can be used. In the case of a legal size sheet, it will be additionally gripped by first sheet gripper clip 114.

Still referring to FIGS. 1 and 2 and envisioning the feeding of the subsequent or next sheet, from what has been previously described, it is clear that this sheet will be skewed or offset in an alternate fashion to third sheet 14. More about this aspect of the invention is covered in the discussion of the method according to the invention herein-to-follow, and in the "Statement of the Operation" of the invention hereinafter.

Figure 3:
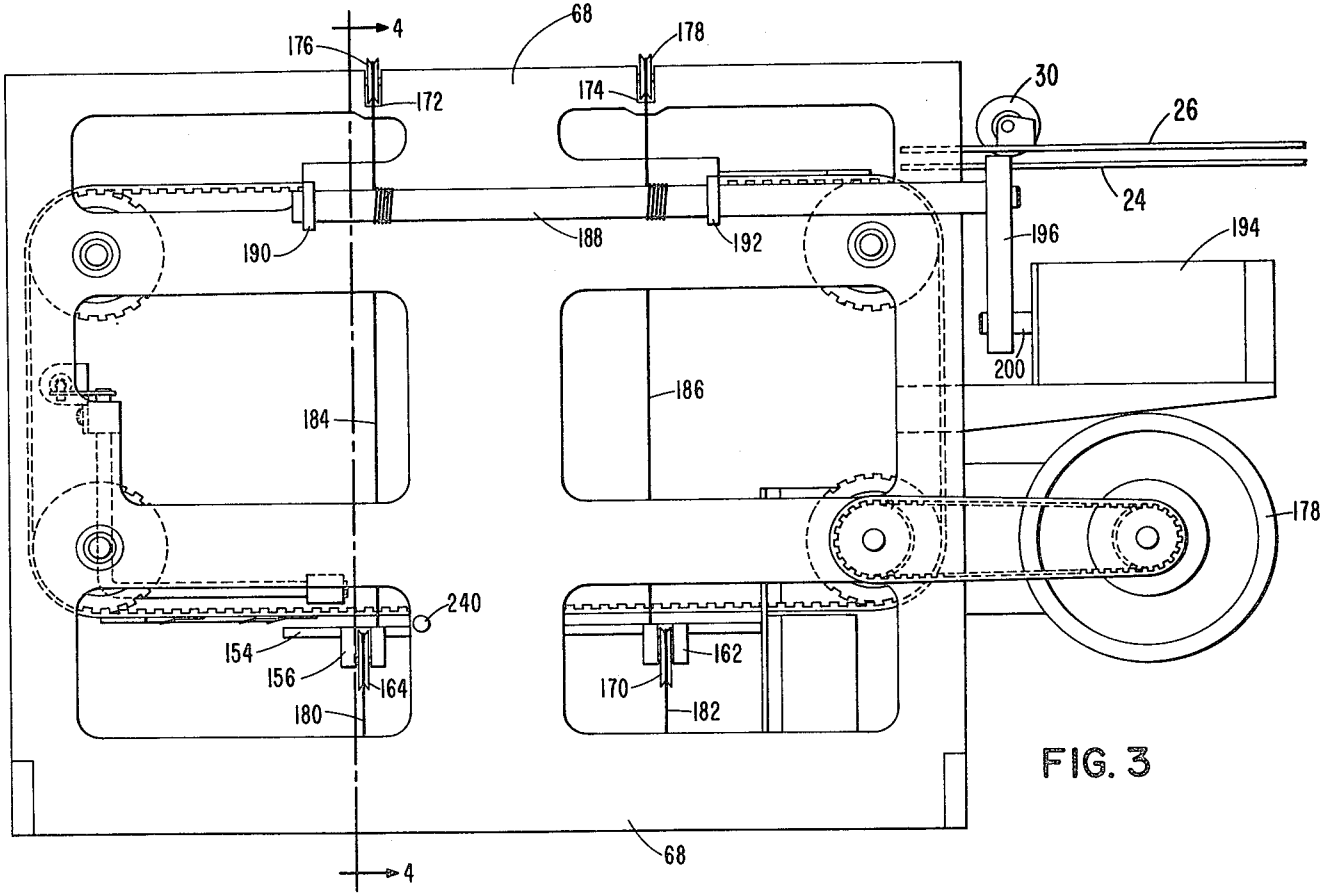
FIG. 3 is a side elevational view of the apparatus, according to the invention, depicting, inter alia, the arcuate sheet transport station, and showing the arcuate sheet transport path to and through the unitary bin sheet receiving station.

Referring now to FIGS. 1 and 3 concurrently, unitary bin sheet receiving station 22 comprises, inter alia, movable sheet platform 154 which has integral thereto a plurality of sheet platform support pulley blocks 156, 158 (better depicted in FIG. 4), 160 and 162. Operatively connected to each of the aforementioned sheet platform support pulley blocks are a plurality of sheet platform support pulleys 164, 166 (depicted in FIG. 4), 168 and 170. An additional part of unitary bin sheet receiving station 22 is a pair of sheet platform lift pulley blocks 172 and 174 integral to main support frame 68. Operatively connected to the aforementioned sheet platform lift pulley blocks are sheet platform lift pulleys 176 and 178, respectively.

Figure 4:
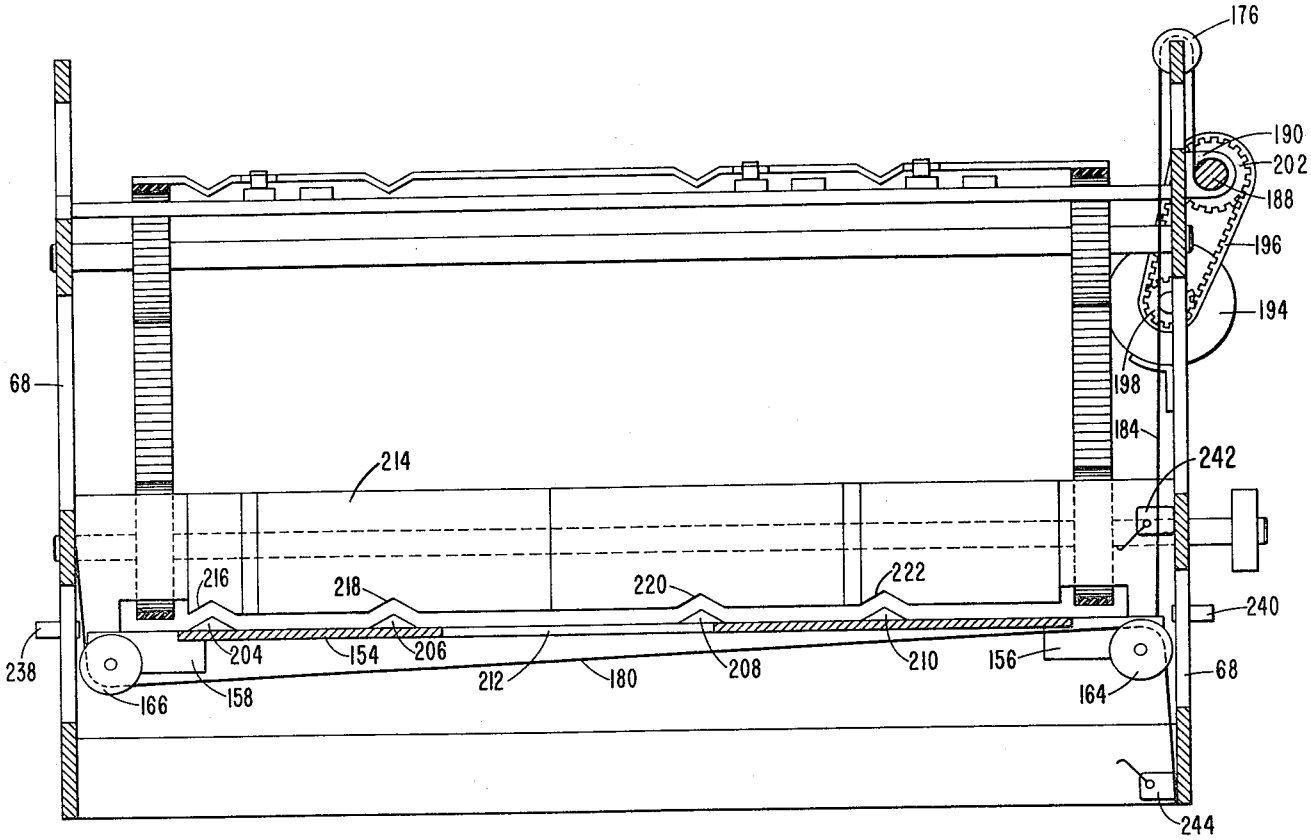
FIG. 4 is a sectional view of FIG. 3 taken along the lines 4—4 showing, inter alia, how the "unibin" of the unitary bin sheet receiving station is raised and lowered.

To continue, and additionally referring to FIG. 4 concurrently, sheet platform support cable 180 has an end secured to one side of main support frame 68 and is routed under sheet platform support pulley 166 and over sheet platform support pulley 164 with the other end secured to the other side of main support frame 68. Similarly, sheet platform support cable 182 is secured to the same one side of main support frame 68 and routed under sheet platform support pulley 168 and over sheet platform support pulley 170 with the other end secured to the same other side of main support frame 68. Thus, movable sheet platform 154 is secured in a balanced condition and has the capability of being raised or lowered while maintaining this balanced condition.

The raising or lowering of movable sheet platform 154 is accomplished by securing one end of sheet platform lift cable 184 to sheet platform support pulley block 156, and securing one end of sheet platform lift cable 186 to sheet platform support pulley block 162. The aforementioned cables are then routed over sheet platform lift pulleys 176 and 178, respectively, with their other ends symmetrically spaced and secured to sheet platform lift shaft 188. Sheet platform lift shaft 188, in turn, is journaled into sheet platform lift shaft supports 190 and 192 secured to main support frame 68 thereby allowing free rotation of the aforementioned lift shaft. Driving power to sheet platform lift shaft 188 for raising or lowering movable sheet platform 154 is provided by sheet platform reversible lift motor 194 via sheet platform reversible lift motor timing belt 196. This timing belt couples sheet platform reversible lift motor pulley 198, fixedly attached to sheet platform reversible lift motor shaft 200, and sheet platform lift shaft pulley 202, fixedly attached to sheet platform lift shaft 188, aforementioned.

Figure 6A:
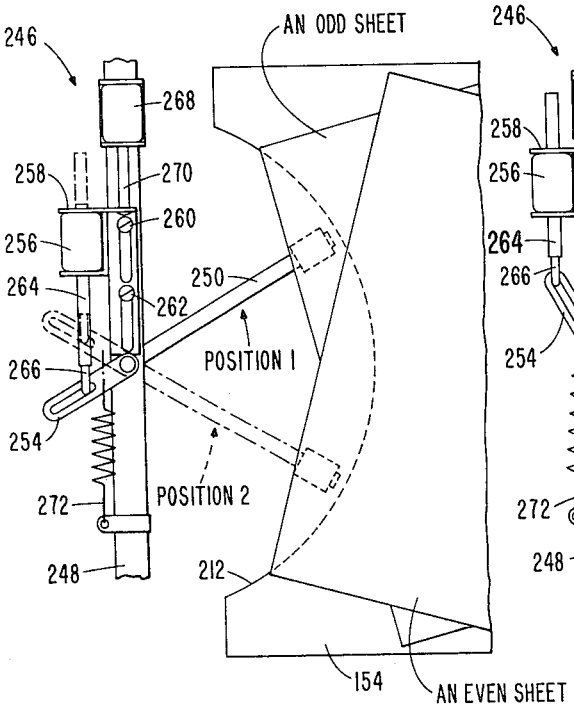
Figure 6B:
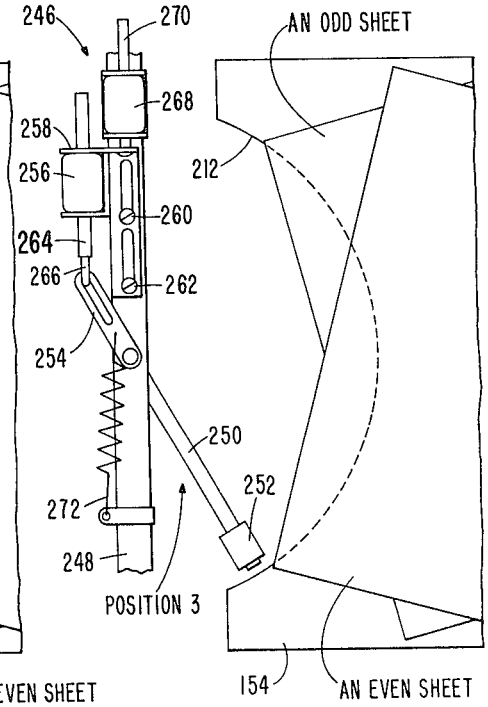

Movable sheet platform 154 is also configured to include sheet platform arcuate cutout 212, the purpose of which is explained hereinbelow in the description of FIGS. 6*a* and 6*b*.

Referring now to FIGS. 1 and 4, concurrently, movable sheet platform 154 is configured to work in conjunction with sheet stack constraining wall 214 included in unitary bin sheet receiving station 22. The aforementioned wall includes a plurality of sheet platform restraining tabs 204, 206, 208 and 210 for restraining the forward motion of alternate sheets that are being concurrently collated, sorted and stacked. Sheet stack constraining wall 214 is disposed juxtapositioned to the back edge of movable sheet platform 154 and securely fastened to main support frame 68 so that as sheets are constrained, they will conform alternately in an offset fashion to the wall configuration thereof. In addition, sheet stack constraining wall 214 includes a plurality of constraining wall retaining tab cutouts 216, 218, 220, and 222 which are the mirror images of the aforementioned sheet retaining tabs 204, 206, 208 and 210, respectively, and are disposed thereabove such that an exit space is provided through sheet stack constraining wall 214 for first and second sheet grippers 84 and 96, previously mentioned. It should be clear that first sheet gripper bar serrated contours 92, 94, 96 and 98, and second sheet gripper bar serrated contours 116, 118, 120 and 122, due to the configurations thereof, can negotiate the aforementioned exit space provided. Thus, in carrying out the method of the invention the aforementioned sheet grippers travel to and through unitary bin sheet receiving station 22.

Referring to FIGS. 1 and 5 concurrently, affixed to the backside of sheet stack constraining wall 214 is exit camming contour plate 224 having disposed and affixed thereto a plurality of first sheet gripper exit camming contours 226, 228 and 230 and a plurality of second sheet gripper exit camming contours 232, 234 and 236. The aforementioned sheet gripper exit camming contours are situated such that the plurality of first sheet gripper clips 110, 112 and 114 of first sheet gripper 84 are cammed open respectively and simultaneously by the aforementioned plurality of first sheet gripper exit camming contours thereby releasing a sheet to be concurrently collated, sorted and stacked into movable sheet platform 154. The corresponding plurality of sheet restraining tabs, aforementioned, operate concurrently to restrain the forward motion of the sheet. Similarly, the plurality of second sheet gripper clips 134, 136 and 138 of second sheet gripper 86 are cammed open respectively and simultaneously by the aforementioned plurality of second sheet gripper exit camming contours thereby releasing a sheet to be concurrently collated, sorted and stacked into movable sheet platform 154. Likewise, the corresponding plurality of sheet restraining tabs, aforementioned, operate concurrently to restrain the forward motion of this sheet.

Referring again to FIGS. 3 and 4 concurrently, but primarily to FIG. 4, sheet platform indexing light source 238 is disposed on and secured to one side of main support frame 68, and disposed on and secured to the one other side thereof, and in line with sheet platform indexing light source 238 is sheet platform indexing light sensor 240. Hence, a narrow light beam either traverses the paper path or is blocked therefrom providing, thereby, information to the system control logic to lower and/or stop movement of movable sheet platform 154. Also mounted on the one other side of main support frame 68 are lever actuated sheet platform upper limit switch 242 and lever actuated sheet platform lower limit switch 244. The aforementioned upper limit switch indicates to the system control logic a condition for the start of operation, and conversely, the aforementioned lower limit switch indicates to the system control logic a condition for the completion of operation.

The foregoing conditions and operations are explained more fully hereinafter under the heading "Statement of the Operation".

Referring now to FIGS. 1, *6a* and *6b*, concurrently, but primarily to FIGS. *6a* and *6b*, reciprocating sheet separator supporter mechanism 246, a part of unitary bin sheet receiving station 22, is disposed symmetrically about the sheet path and comprises, inter alia, reciprocating sheet separator supporter mechanism mounting bar 248 fixedly attached to the sides of main support frame 68. Pivotally attached to the aforementioned mounting bar is one end of reciprocating sheet separator supporter arm 250. On the other end thereof is rotatively mounted sheet friction reducing roller 252. Being freely rotatable, sheet friction reducing roller 252 reduces the drag friction on sheets being concurrently collated, sorted and stacked during the reciprocating action of reciprocating sheet separator supporter arm 250. Fixedly attached to the one end, aforementioned, of reciprocating sheet separator supporter arm 250 is reciprocating bell crank 254.

Continuing, reciprocating position solenoid 256 is affixed to slidable mounting bracket 258 which, in turn, is operatively secured to reciprocating sheet separator supporter mechanism mounting bar 248 by shoulder fasteners 260 and 262. Also, operatively connected to reciprocating position solenoid 256, aforementioned, is reciprocating position solenoid plunger 264 which has fixedly attached thereto reciprocating position solenoid link 266. Reciprocating position solenoid link 266 operatively couples reciprocating position solenoid 256 to reciprocating bell crank 254 such that upon activation of reciprocating position solenoid 256, reciprocating sheet separator supporter arm 250 is reciprocated from a first position to a second position as shown in phantom detail in FIG. *6a*. In addition, as aforementioned, sheet platform arcuate cutout 212 allows reciprocating sheet separator supporter arm 250 to reciprocate freely from the first position to the second position.

Referring now primarily to FIG. *6b*, reciprocating sheet separator supporter arm 250 is shown in a third or home position. In order to accomplish the foregoing, home position solenoid 268 is securely attached to reciprocating sheet separator supporter mechanism mounting bar 248. Operatively connected to home position solenoid 268 is home position solenoid plunger 270 which is fixedly attached to slidable mounting bracket 258. Accordingly, when home position solenoid 268 is activated by the system control logic, reciprocating sheet separator supporter arm 250 is rotated to the third or home position as shown. Thus, with reciprocating sheet separator supporter arm 250 in this position, movable sheet platform 154 can be raised or lowered without disturbing the sheets therein.

Finally, when home position solenoid 268 is deactivated, reciprocating position solenoid return spring 272, having one end fixedly attached to reciprocating sheet separator supporter mechanism mounting bar 248, and the other end thereof fixedly attached to reciprocating bell crank 254, supplies a return force which causes reciprocating sheet separator supporter arm 250 to rotate to the first position, and reciprocating position solenoid 256 via slidable mounting bracket 258 to slide back into position as shown in FIG. *6a*.

Although the method, according to the invention, termed "offset collation" has been discussed indirectly in describing the apparatus according to the invention, it can better be understood by referring to FIGS. *7a* through *7f* in sequence along with the discussion herein-to-follow.

By way of example, assume the job size and job configuration to be concurrently collated, sorted and stacked to consist of nine (9) sets with each set containing twenty five (25) sheets or pages. Thus for this example, the total number of sheets in the job, i.e., job size, is two hundred twenty five (225).

It should be clear that the method herein, to be further described, has no limitations as to job size or job configuration, i.e., the number of sets in a job or the number of sheets in a set. However, the apparatus to carry out the method has practical limitations due to the weight of the sheets and the height of a stack that can be conveniently handled manually by an operator or automatically by other means.

As illustrated in FIG. *7a*, the method of "offset collation" is taking place. However, prior to the start of collation, the system control logic has initiated and completed a "homing procedure". At the start of the "homing procedure", reciprocating sheet separator supporter arm 250 is in position 3 so that movable sheet platform 154, as indicated by the direction arrow, can be raised to a "home position", or a position to receive sheets. Sheet platform indexing light source 238 and sheet platform indexing light sensor 240 cooperates with the system control logic such that the light beam from sheet platform indexing light source 238 is not obstructed. In addition, reciprocating sheet separator supporter arm 250 is rotated to position 1 as shown. Thus, when sheet 1 of set 1, i.e., a sheet corresponding to an odd set, is inserted into movable sheet platform 154, reciprocating sheet separator supporter arm 250 is in position 1. On the other hand, as shown by the phantom view thereof, when a sheet corresponding to an even set, such as sheet 1 of set 8, is inserted into movable sheet platform 154, reciprocating sheet separator supporter arm 250 is in position 2.

Accordingly, when sheets corresponding to odd sets are inserted into movable sheet platform 154, reciprocating sheet separator supporter arm 250 is in position 1 and when sheets corresponding to even sets are inserted, reciprocating sheet separator supporter arm 250 is rotated to position 2. Furthermore, during the "offset collation" operation, the light beam is not obstructed. Hence, as shown, the next sheet in sequence, that is sheet 1 of set 9, is being inserted into movable sheet platform 154 by first sheet gripper 84. It should be noted that the sheets have been inserted alternately in an offset fashion, the offset clearly demarcating each first sheet from adjacent first sheets.

Figure 7A:
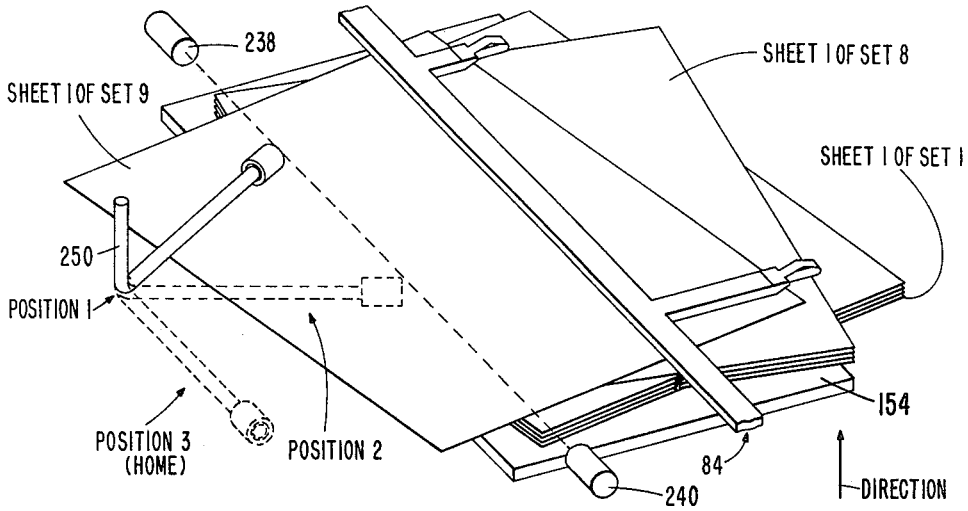
Figure 7B:
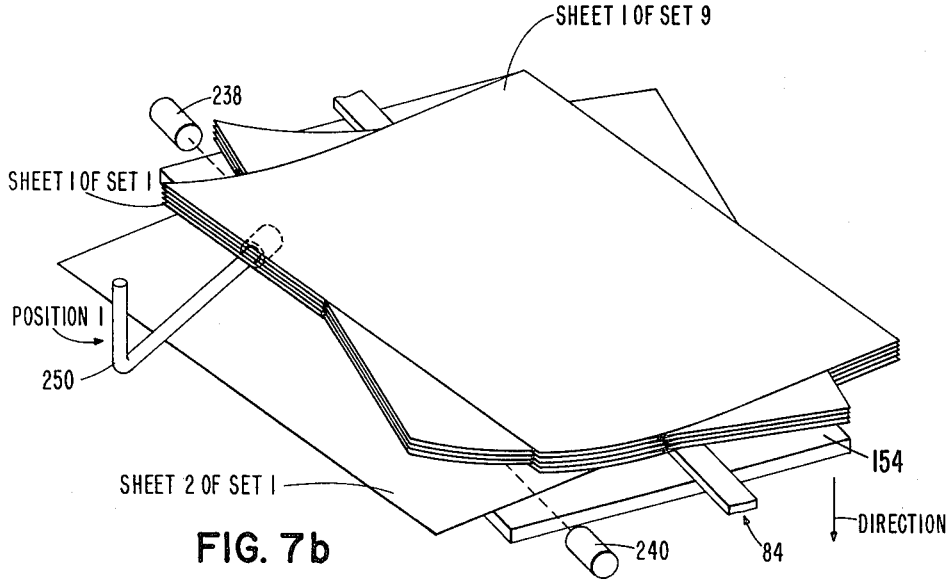

As illustrated in FIG. *7b*, another "homing procedure" has been initiated and completed, and as depicted, reciprocating sheet separator supporter arm 250 is supporting and separating the first 9 sheets corresponding to sheet 1 or page 1, respectively, of the 9 sets to be concurrently collated, sorted and stacked. As indicated in the discussion of FIG. *7a*, a "homing procedure" is initiated by the system control logic. Thus, reciprocating sheet separator supporter arm 250 is rotated to position 3 or the "home position". Then, movable sheet platform 154 is raised in the direction shown by the arrow in FIG. 7*a* until the light beam from sheet platform indexing light source 238 is obstructed by movable sheet platform 154. This is the topmost position of movable sheet platform 154. In the meantime, reciprocating sheet separator supporter arm 250 is rotated to position 1 such that it is beneath the sheets in movable sheet platform 154. Now since the light beam, previously mentioned, is obstructed, movable sheet platform 154 is lowered as shown by the direction arrow in FIG. 7*b*. Thus, the left corner, i.e., the odd separation and support corner, of the alternately stacked sheets in movable sheet platform 154 is supported by reciprocating sheet supporter separator arm 250 as shown. Also as shown, the light beam is no longer obstructed. Consequently, the conditions are correct for the insertion of sheet 2, i.e., the second page of set 1 by first sheet gripper 84. It should be noted that sheet 1 of set 1 is resting directly on reciprocating sheet separator supporter arm 250.

Figure 7C:
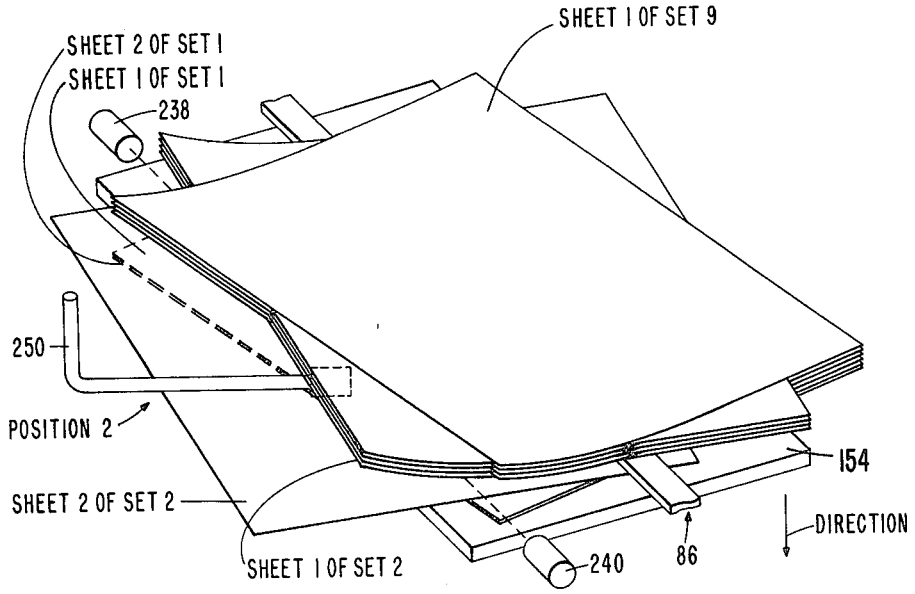

Referring now to FIG. 7*c*, the sequence of operation is such that reciprocating sheet separator supporter arm 250, while still supporting the sheets is rotated to position 2, thereby dropping sheet 1 of set 1 onto sheet 2 of set 1. Thus, reciprocating sheet separator supporter arm 250 is now supporting the right corner, i.e, the even separation and support corner, of the alternately stacked sheets in movable sheet platform 154. Also, as shown, sheet 1 of set 2 is resting directly on reciprocating sheet separator supporter arm 250 such that sheet 2 of set 2 can be inserted, by second sheet gripper 86, contiguous to sheet 1 of set 2. After insertion, reciprocating sheet separator supporter arm 250 is rotated to position 1, thereby dropping sheet 1 of set 2 onto sheet 2 thereof.

Continuing, and still referring to FIG. 7*c*, the light beam from sheet platform indexing light source 238, at this point in time, is not obstructed. However, after about 25 sheets have been inserted into movable sheet platform 154, the light beam will become obstructed. Consequently, the system control logic will operate to cause movable sheet platform 154 to be lowered, as indicated by the direction arrow, until the light beam from sheet platform indexing light source 238 to sheet platform indexing light sensor 240 is no longer obstructed. After the foregoing operation, the method is continued as previously described.

Figure 7D:
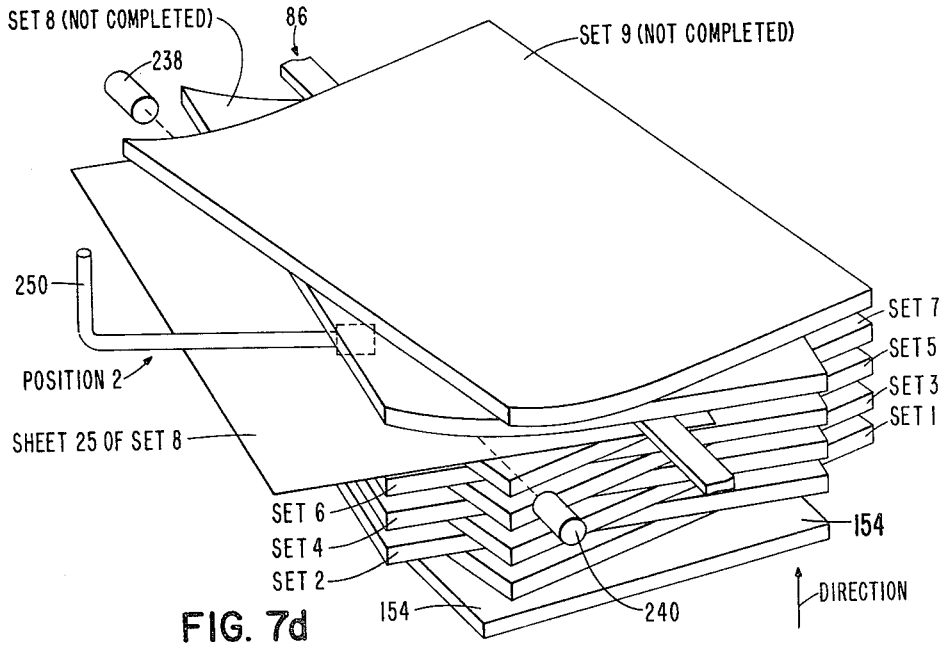

FIG. 7*d* depicts the method of "offset collation" at a later point in time at which sets 1 through 7 have been completed. Thus, as shown, reciprocating sheet separator supporter arm 250 is in position 2 supporting the right corner of set 8, not completed. However, as further illustrated, sheet 25 of set 8 is being inserted into movable sheet platform 154 by second sheet gripper 86, thereby completing set 8. It should also be noted that as the height of the stack increases, movable sheet platform 154 is lowered whenever the light beam from sheet platform indexing light source 238 is obstructed from sheet platform indexing light sensor 240. As aforementioned, this operation occurs, each time, after the insertion of about 25 sheets in movable sheet platform 154.

Figure 7E:
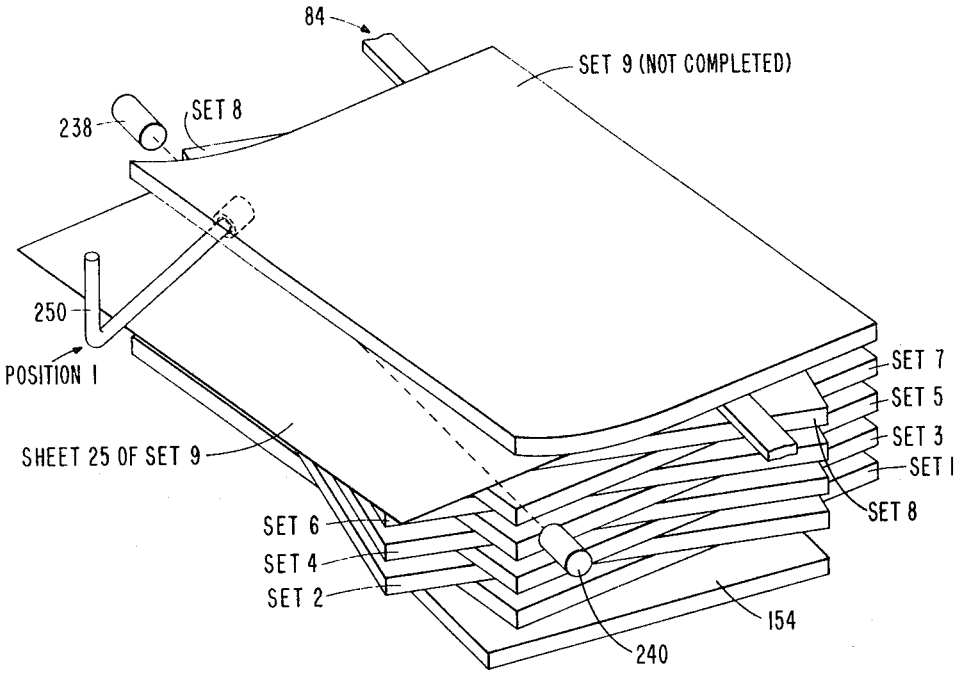

For the example illustrated, FIG. 7*e* depicts sheet 25 of set 9 being inserted into movable sheet platform 154 by first sheet gripper 84. Reciprocating sheet separator supporter arm 250 is shown in position 1 supporting the left corner of set 9, not completed. Up to this point in time, 8 sets have been completed. However, as further illustrated, reciprocating sheet separator supporter arm 250, after the insertion of sheet 25 of set 9, is rotated to position 2, thereby dropping the prior inserted sheets of set 9 onto sheet 25 thereof.

Figure 7F:
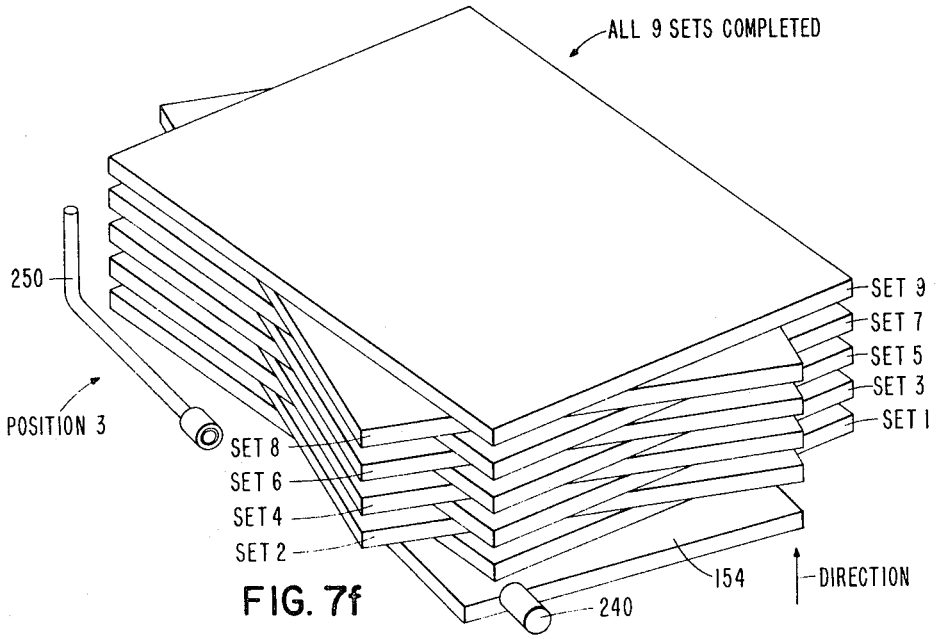

FIG. 7*f* depicts the final operation of the method according to the invention. As shown, all 9 sets have been completed at which time reciprocating sheet separator supporter arm 250 is rotated to position 3 or the "home position". Movable sheet platform 154, as shown by the direction arrow, is raised to its upper position making for convenient removal of the concurrently collated, sorted and stacked sets manually or otherwise.

STATEMENT OF THE OPERATION

Details of the operation, according to the invention, are now described primarily in conjunction with the schematic diagram of FIG. 8 and the timing diagram of FIG. 9. Elements of the apparatus, according to the invention, shown in FIGS. 1 through 6*b* that correspond to those depicted by schematic representation in FIG. 8 are represented by the same reference numbers. However, those elements not previously described are represented by additional designations as shown in the system control logic schematic of FIG. 8.

As can be seen from FIG. 8, the instant invention uses electro-mechanical technology for logic control in order to simplify the logic requirements, i.e., the number of independent functions to be performed, and also to allow these functions to be more or less mechanically automated. Not withstanding the foregoing, this does not mean that a more sophisticated technology for logic control, e.g., solid state circuitry (micro-processors), has not been contemplated.

Referring then to FIG. 8, at the beginning of operation, a "homing procedure" is initiated by a ground potential, signal being applied to movable sheet platform homing signal line 274 from electro-mechanical down counter 276. If the apparatus of the invention is to be used as an "online collator", then the aforementioned ground potential or homing signal is taken from its associated copier, duplicator, printer or like machine. These machines usually have, incorporated therein, a continuous counter which is operated electro-mechanically or electronically on each copy cycle. The continuous counter has a copy number selector dial having, for example for the electro-mechanical case, 21 numbered positions. Thus, if an operator sets the copy number selector dial to ten (10), as copies are made, the copy number selector dial is driven, electro-mechanically, down to zero (0) at which point the aforementioned ground potential signal is provided to be used for various functions in the copier. This is the signal that is applied to movable sheet platform homing signal line 274 to start the "homing procedure". For a complete explanation of an electro-mechanical continuous counter that is typical of those used in reproduction machines such as the IBM Copier II, see "Copier II Service Manual", Form No. 241-5705-0, August, 1972, pages 141 and 142.

On the other hand, if the apparatus of the invention is to be used as an "offline collator", and have some measure of automation, then electro-mechanical down counter 276 can be used as shown in FIG. 8. For purposes of the invention, electro-mechanical down counter 276 can be simpler, in configuration and operation, than the devices commonly used in copiers such as the IBM Copier II. This is so because the ground potential signal is to be used only for a single function. Thus, electro-mechanical down counter 276 can comprise a knob, with an indicator thereon, mounted on a shaft, which may be rotated by an operator to one of several detented positions such that the indicator points to a number 0 through N on a dial. Also mounted on the shaft can be a ratchet with N teeth, and a cam with one lobe for actuating a switch when the indicator is at the zero (0) position. A pawl, actuated by a solenoid, can work in conjunction with the ratchet such that when the solenoid is energized it causes the shaft to rotate, thereby moving the indicator to the next lower number.

To continue, the ground potential or homing signal through the normally closed contact, R3-1 of Relay 3, picks or energizes Relay 1 which is held energized as long as the homing signal is present. Accordingly, normally opened contacts R1-4 and R1-5 thereof are made causing reciprocating position solenoid 256 and home position solenoid 268, respectively, to be energized thereby rotating reciprocating sheet separator supporter arm 250 to position 3. Also, normally opened contact R1-1 is made thereby energizing Relay 5 through lever actuated sheet platform upper limit switch 242. Thus, normally opened contact R5-1 is made energizing sheet platform reversible left motor 194 causing movable sheet platform 154 to be raised which, in turn, causes lever actuated sheet platform upper limit switch 242 to be actuated. When this occurs, Relay 5 is de-energized. Hence, sheet platform reversible left motor 194 is also de-energized causing movable sheet platform 154 to come to rest at a full up position. Since the ground potential signal at movable sheet platform homing line 274 is only present when the indicator of electro-mechanical down counter 276 is at the zero (0) position, when it is set to a selection other than zero (0) Relay 1 becomes de-energized and reciprocating sheet separator supporter 250 returns to position 1.

Now with movable sheet platform 154 at rest in the full up position, the edge thereof obstructs the light beam to sheet platform indexing light sensor 240 from sheet platform indexing light source 238. Thus, sheet height sensor 278, shown in FIG. 8, provides at sheet height sensor output line 280 a ground potential or movable sheet platform lowering signal which, through the normally closed contacts Re-2 of Relay 3, lever actuated sheet platform lower limit switch 244 and R1-2 of Relay 1, causes Relay 2 to be picked. Consequently, sheet platform reversible lift motor 194, via contact R2-1 of Relay 2, is energized such that it is driven in a reverse direction thereby causing movable sheet platform 154 to be lowered until the light beam from sheet platform indexing light source 238 to sheet platform indexing light sensor 240 is unobstructed. Now the ground potential signal from sheet height sensor 278 via amplifier A thereof, and at sheet height sensor output line 280, increases to the supply voltage V thereby de-energizing Relay 2, and accordingly, opening contact R2-1 causing sheet platform reversible lift motor 194 to be de-energized. Hence, after the completion of the foregoing operation, i.e., "homing procedure", unitary bin sheet receiving station 22 is in the proper position for the feeding of the first sheets or pages of sets to be concurrently collated, sorted and stacked, according to the invention.

Continuing and still referring to FIG. 8, as a sheet actuates lever actuated sheet path switch 38, Relay 3 is picked and held, i.e., latched on, through its own holding coil, contact R3-3 and the normally closed contacts of lever actuated first sheet gripper position switch 40 and lever actuated second sheet gripper position switch 42. Also, as aforementioned, when the normally opened contact of lever actuated sheet path switch 38 is made, the solenoid in electro-mechanical down counter 276 is energized causing a count-down to the next lower number on the indicator dial. It should be noted that although the normally opened contact of lever actuated first sheet gripper position switch 40 is made, Relay 4 is not energized due to the fact that lever actuated collate ready and runout switch 282 is not made.

As previously mentioned, Relay 3 has been energized. Hence, via contact R3-4 thereof, gripper drive motor 78 is energized causing first sheet gripper 84 to advance towards unitary bin sheet receiving station 22, and second sheet gripper 86 to advance through unitary bin sheet receiving station 22 and to the home position, i.e., the position to receive the next sheet (see FIG. 1). Thus, lever actuated second sheet gripper position switch 42 is actuated, thereby opening its normally closed contact, causing Relay 3 to be de-energized. Consequently, gripper drive motor 78 is de-energized.

The next sheet (in this case the second sheet) is now gripped by second sheet gripper 86. It should be noted that the first sheet in first sheet gripper 84 will have advanced to the entrance of unitary bin sheet receiving station 22 and will have made lever actuated collate ready and runout switch 282 (see FIG. 1). Nevertheless, as shown in FIG. 8, Relay 4 is not energized now due to the normally opened contact of lever actuated first sheet gripper position switch 40 not being made.

Now, after first sheet gripper 84 has deposited the first sheet in unitary bin sheet receiving station 22, it is moved back into the home position to receive another sheet (in this case the third sheet). Accordingly, the normally opened contact of lever actuated first sheet gripper position switch 40 is made and since the second sheet, gripped by second sheet gripper 86, has been advanced to the entrance of unitary bin sheet receiving station 22, lever actuated collate ready and runout switch 282 is made, thereby picking or energizing Relay 4. Relay 4 is latched on by its holding coil, contact R4-2 and the normally closed contact of lever actuated second sheet gripper position switch 42, aforementioned. Thus, contact R4-1 of Relay 4 is made thereby energizing reciprocating position solenoid causing reciprocating sheet separator supporter arm 250 to rotate to position 2.

Continuing, the next sheet (in this case the fourth sheet) is then gripped by second sheet gripper 86 and the foregoing process is repeated. However, as more sheets are concurrently collated, sorted and stacked in movable sheet platform 154, again, the light beam to sheet platform indexing light sensor 240 from sheet platform indexing light source 238 is obstructed causing sheet height sensor 278, via amplifier A thereof, to provide a ground potential signal at sheet height sensor output line 280. Thus, Relay 2 is energized through the normally closed contacts R3-2 and R1-2 of Relays 3 and 1, respectively, and lever actuated sheet platform lower limit switch 244. Accordingly, as previously discussed, movable sheet platform 154 is lowered until the sheets therein are below the light beam.

After all of the first sheets or pages, numbering up to the number of sets to be offset collated, have been inserted into movable sheet platform 154, the aforementioned "homing procedure" is repeated. Then the second sheets or pages are inserted and the method is continued.

After the last sheet or page of the last set has been inserted into movable sheet platform 154, a final "homing procedure" is initiated, as previously described, raising movable sheet platform 154 so that the collated, sorted and stacked sets can be conveniently removed.

On the other hand, if the full capacity of the apparatus is reached before the finishing of a job, movable sheet platform 154 actuates lever actuated sheet platform lower limit switch 244 causing the opening of its normally closed contacts thereby de-energizing Relays 2 and 3 and thus stopping the collation process. For this special case, according to the apparatus disclosed, a final "homing procedure" must then be initiated by manually setting electro-mechanical down counter 276 to zero (0).

Referring now to the segmented timing diagram of FIG. 9, the events illustrated therein are designed to reiterate and reinforce the method according to the invention, in terms of the example discussed in conjunction with FIGS. 7*a* through 7*f*, and the discussion of the system control logic of FIG. 8.

As shown in FIG. 9, at time $T_0$ at movable sheet platform homing signal line 274, a ground potential or homing signal, represented by a down level, is initiated. Nevertheless, sheet platform reversible lift motor 194 is not energized, since movable sheet platform 154 is already at a full up position from the previous operation. A selection is then made on electro-mechanical down counter 276 that removes the ground potential signal at movable sheet platform homing signal line 274. As aforementioned, in conjunction with the discussion of the system control logic of FIG. 8, with movable sheet platform 154 at rest in the full up position, the edge thereof obstructs the light beam. Thus, when Relay 1 is de-energized, normally closed contact R1-2 closes and allows sheet height sensor 278 to provide a ground potential or movable sheet platform lowering signal, represented by a down level. Consequently, sheet platform reversible lift motor 194 is energized so that it is driven in a reverse direction thereby causing movable sheet platform 154 to be lowered until the light beam is unobstructed. After the foregoing operation, the "homing procedure" is completed and movable sheet platform 154 is in the proper position for the feeding of the first sheet.

At time $T_1$, the first sheet actuates lever actuated sheet path switch 38. Now, as also aforementioned, first sheet gripper 84 is in the home position as indicated by lever actuated first sheet gripper position switch 40 being actuated at time $T_0$. Hence, the first sheet is gripped slightly after time $T_1$. The actuation of lever actuated sheet path switch 38, in addition, causes gripper drive motor 78 to be energized, advancing first sheet gripper 84 towards unitary bin sheet receiving station 22, and at the same time, advancing second sheet gripper 86 to and through unitary bin sheet receiving station 22, and to the home position, i.e., the position to receive the first sheet of set 2. When second sheet gripper 86 reaches the home position, lever actuated second sheet gripper position switch 42 is actuated at a time between $T_1$ and $T_2$ such that when lever actuated sheet path switch 38 is actuated by the second sheet, gripper drive motor 78 is energized again. As shown, this operation occurs whenever a sheet actuates lever actuator sheet path switch 38. Also, as shown, lever actuated collate ready and runout switch 282 is actuated at a time between $T_1$ and $T_2$ but has no effect on the operation of reciprocating position solenoid 256, at this time, because the aforementioned switch is actuated by the first sheet of set 1 which has been advanced to the entrance of unitary bin sheet receiving station 22 by first sheet gripper 84. Hence, the normally opened contact of lever actuated first sheet gripper position switch 40 is not made. Accordingly, Relay 4 is not energized.

As aforementioned, the operation of reciprocating position solenoid 256 causes reciprocating sheet separator supporter arm 250 to be in either position 1, represented by a down level in FIG. 9, or position 2, represented by an up level therein. Thus, when lever actuated first sheet gripper position switch 40 is actuated again and this occurs when first sheet gripper 84 is in the home position for the second time, reciprocating position solenoid 256 is energized since both lever actuated first sheet gripper position switch 40 and lever actuated collated ready and runout switch 282 are made, therefore, reciprocating sheet separator supporter arm 250 is moved to position 2 at a time between $T_2$ and $T_3$. However, when lever actuated second sheet gripper position switch 42 is actuated, causing reciprocating position solenoid 256 to be de-energized, reciprocating sheet separator supporter arm 250 is rotated to position 2 which occurs after the time $T_3$. The operation is alternately repeated with no significant changes in operation until the height of the stack becomes significant as depicted by the example between the times $T_{199}$ and $T_{200}$.

At time $T_{199}$, the 20th sheet of the 8th set has actuated lever actuated sheet path switch 38 and at time $T_{200}$, the 20th sheet of set 9 has actuated the aforementioned switch. At these particular periods in time, it is shown that sheet height sensor 278 provides a ground potential signal, represented by a down level, which causes sheet platform reversible lift motor 194, to lower movable sheet platform 154, until the light beam is unobstructed. Then, the operation continues. Also, at time $T_{200}$, another "homing procedure" is initiated since shortly after that time, the 20th sheet of the last set, i.e., set 9, will have been inserted into movable sheet platform 154 and the indicator will be at zero (0). Accordingly, a ground potential signal or home signal is shown at movable sheet platform homing signal line 274. Also, a ground potential is at runout signal line 284 provided by the same switch in electro-mechanical down counter 276. For purposes of the invention the aforementioned switch has two isolated contacts which are both made whenever the indicator is at zero (0).

When the foregoing occurs, Relay 3 will continue to be held energized through the normally closed contact of lever actuated first sheet gripper position switch 40 and/or lever actuated collate ready and runout switch 282 being made until all sheets have been deposited into unitary bin sheet receiving station 22 and that first sheet gripper 84 has returned to the home position. Sheet platform reversible left motor 194 is then energized, causing movable sheet platform 152 to be raised.

Referring to FIGS. 8 and 9 concurrently, it can be seen that contact 1 of lever actuated collate ready and runout switch 282 is used to ensure that Relay 4 is picked only when lever actuated first sheet gripper position switch is made and when a sheet is ready to be inserted into unitary bin sheet receiving station 22. Accordingly, due to the foregoing operation reciprocating sheet separator supporter arm 256 will always be in the proper position to receive the proper sheet and will not drop sheets supported thereby prematurely.

In the case of a job requiring an even number of sets, contact 2 of lever actuated collate ready and runout switch 282 being made maintains Relay 3 in hold when electro-mechanical down counter 276 has reached zero (0). Accordingly, a ground potential is provided on runout signal line 284, aforementioned, that allows two additional cycles to ensure that all sheets have been deposited into unitary bin sheet receiving station 22 and that first sheet gripper is returned to the home position.

In the case of a job requiring an odd number of sets, like the example illustrated herein, only one additional cycle is required to ensure the foregoing.

As shown in FIG. 8, at time $T_{247}$ the 25th sheet of set 8 has actuated sheet path switch 38. The operation will continue as previously described. However, as shown, the conditions are such that sheet height sensor 278 provides a ground potential signal which energizes sheet platform reversible lift motor 194, causing movable sheet platform 154 to be lowered until the light is unobstructed.

Now at time $T_{248}$, the 25th or last sheet of set 9 has actuated lever actuated sheet path switch 38. The operation continues as previously described, and at this point in time, a final "homing procedure" is initiated. The complete "homing procedure" also includes energizing home position solenoid 268 when reciprocating position solenoid 256 is energized. This operation causes reciprocating sheet separator supporter arm 250 to rotate to position 3. This operation, inter alia, causes sheet platform reversible lift motor 194 to be energized, thereby raising movable sheet platform 154, as previously described. At time $T_{249}$, the final "homing procedure" is continued and at time $T_{250}$, it is completed.

While the invention has been particularly described with reference to the preferred embodiment thereof, it will be understood by those skilled in the art that various changes in form and detail may be made therein without departing from the scope and spirit of the invention.

Having thus described my invention, what I claim as new and desire to secure by Letters Patent is:

1. An apparatus termed "offset collator" for collating wherein sheets are concurrently collated, sorted and stacked to form collated, sorted and stacked sets wherein each set includes plural sheets, comprising in combination:

an entry station for feeding, in sequence, said sheets of sets to be offset collated fed thereto in said sequence, wherein said sequence is defined as the feeding of the first sheet of each set to be offset collated, numbering up to and corresponding to the number of sets to be offset collated, and the subsequent feeding, in turn, of additional sheets of each set numbering up to and corresponding to the number of sheets in a set;

transport station means for offsetting alternate ones of said sequentially supplied sheets of sets to be offset collated, and for transporting in said sequence in a predetermined path, said offset sheets of sets to be offset collated, and for thereby cooperating with said entry station to form an alternate offset of the sheets in said sequence;

a receiving station means for receiving in said sequence and in said alternate offset fashion said sheets of sets to be offset collated, said receiving station means comprising "unibin" means for holding therein a single stack of said sheets all in face-to-face contact with one another, and means for cooperating with said transport station means for inserting the first sheet of each set to be offset collated in said "unibin" means in said alternate offset fashion, thereby forming a stack and clearly demarcating each said first sheet from adjacent first sheets, means for inserting the second sheet of each set to be offset collated in said stack in said "unibin" means in said alternate offset fashion between and contiguous to each of said first sheets, and for inserting additional sheets of each set to be offset collated, if required by the number of sheets in said sets, in said stack in said "unibin" means in said alternate offset fashion contiguous to each of the prior inserted sheets of its set; and means for controlling said entry station, said transport station means and said receiving station means such that said collated, sorted and stacked sets are concurrently formed in said single stack of said "unibin" means.

2. The apparatus according to claim 1 wherein said "unibin" means of said receiving station means includes a movable sheet platform for receiving the sheets to be offset collated in the proper position in said sequence and for maintaining said sheets in said alternate offset fashion in said stack.

3. The apparatus according to claim 2 wherein said movable sheet platform is movable vertically.

4. The apparatus according to claim 2 wherein:

said alternate offsetting of said transport station means forms thereby offset portions of said sheets received in said stack; and said receiving station additionally comprises a reciprocating sheet separator supporter mechanism for supporting the offset portions of said sheets received in said single stack on said movable sheet platform, while said sheets are in said alternate offset fashion to separate said supported sheets received in said stack from the sheets therebelow while said sheets are in said alternate offset fashion; and said cooperating means cooperates with said transport station means for inserting said second offset sheets therebetween contiguous to each of said first sheets in said stack, and if required by the number of sheets in said sets to be offset collated, to insert said additional offset sheets of each set therebetween contiguous to each of the prior inserted sheets of its set.

5. The apparatus according to claim 1 wherein said transport station means additionally comprises means for skewing alternately, as referenced to a straight line sheet path, each alternate sheet in turn in opposite directions prior to insertion into said receiving station, thereby forming said alternate offset.

6. The apparatus according to claim 5 wherein said transport station means for skewing additionally comprises:

plural gripping means for gripping each said sequentially supplied sheet, and said entry station additionally comprises camming means for engaging said skewing means for alternately skewing said plural gripping means with respect to said straight line sheet path.

7. The apparatus according to claim 1 wherein said predetermined path of said transport station means is arcuate and runs to and through said receiving station.

8. The apparatus according to claim 1 wherein said receiving station means is arranged to receive said sheets horizontally, whereby said collated, sorted and stacked sets are concurrently formed vertically in said single stack therein.

9. A method of collating at least a plurality of first sheets, and a plurality of second sheets, termed "offset collation", wherein said sheets are concurrently collated, sorted and stacked to form collated, sorted and stacked multisheet sets with the sets being in face-to-face contact, each having at least a first sheet and a second sheet, at a receiving station, comprising the steps of:

first alternately inserting in an alternate offset fashion, into said receiving station as a single stack, said first sheet of each said set to be offset collated, numbering up to and corresponding to the number of said sets to be offset collated, said alternate offset clearly demarcating each said first sheet from adjacent first sheets, and forming said single stack;

second alternately inserting in said alternate offset fashion, into said single stack at said receiving station, said second sheet of each said set to be offset collated, numbering up to and corresponding to said number of sets to be offset collated, each of said second sheets being alternately inserted in said alternate offset fashion contiguous to and between each of said first sheets; and repeating, if required by the number of sheets in said sets to be offset collated, the second alternately inserting step, alternately inserting in said alternate offset fashion, into said single stack at said receiving station, additional sheets, in turn, of each said set to be offset collated, numbering up to and corresponding to said number of sets to be offset collated, each of said additional sheets of each set being alternately inserted contiguous to each of the prior inserted sheets of its set, thereby forming concurrently said collated, sorted and stacked sets.

10. The method according to claim 9, including the additional step of moving the stack of received sheets after a predetermined number thereof have been inserted into said stack at said receiving station.

11. The method according to claim 10 wherein said moving step comprises moving said stack of received sheets vertically.

12. The method according to claim 9 wherein said second alternately inserting step comprises the additional steps of:

maintaining the sheets received at said receiving station in said single stack in said alternate offset fashion; and separating said first sheets received in said single stack at said receiving station, while said sheets are in said alternate offset fashion, and alternately inserting said second sheets in said alternate offset fashion contiguous to each of said first sheets, whereby said second sheets of each set are alternately inserted in said single stack contiguous to each of said first inserted sheets of its set.

13. The method according to claim 9 wherein said alternate offset fashion of said alternately inserting steps comprises alternately skewing, as referenced to a straight line sheet path, each sheet, in turn, in opposite directions prior to insertion into said single stack at said receiving station, thereby forming said alternate offset.

14. The method according to claim 9 wherein said alternately inserting steps comprise additionally inserting said sheet horizontally, whereby said collated, sorted and stacked sets are formed vertically.

15. A method of collating at least a plurality of first sheets and a plurality of second sheets into a plurality of sets N, each having at least a first sheet and a second sheet, termed "offset collation", wherein sheets are concurrently collated, sorted and stacked to form collated, sorted and stacked sets into a receiving station, comprising the steps of:

in a first step, alternately inserting, in an offset fashion of alternate odd and even sheets, contiguous to and upon the top of each other, into said receiving station to form a single stack thereof, said first sheet of each said set to be offset collated, numbering up to and corresponding to said number of sets N to be offset collated, said offset clearly demarcating each said first sheet from adjacent first sheets to form an odd separation and support corner for the odd first sheets thereof, and form an alternate even separation and support corner for the even first sheets thereof, wherein said odd first sheets, by said order of insertion, number 1, 3, . . . N, and said even first sheets, by said order of insertion, number 2, 4, . . . N−-1, if N is odd, and wherein said odd first sheets, by said order of insertion, number 1, 3, . . . N−1 and said even sheets, by said order of insertion, number 2, 4, . . . N, if N is even;

in a second step, lifting said odd separation and support corner;

in a third step, offsetting a said second sheet in said odd offset fashion, and inserting under said odd separation and support corner, into said single stack at said receiving station, said second sheet in said odd offset fashion;

in a fourth step, dropping said lifted odd separation and support corner onto the inserted said odd second sheets of its set to be contiguous thereto;

in a fifth step, lifting said even separation and support corner;

in a sixth step, offsetting another said second sheet in said even offset fashion, and inserting under said even separation and support corner, into said single stack at said receiving station, said another second sheet in said even offset fashion;

in a seventh step, dropping said lifted even separation and support corner onto the inserted said even second sheet of its set to be contiguous thereto; and repeating, for the additional number of second sheets in said plurality of sets to be offset collated, said second step, said third step, and said fourth step, for each additional said odd second sheet, and said fifth step, said sixth step and said seventh step, for each additional said even second sheet, thereby forming concurrently said collated, sorted and stacked sets.

16. A method of collating termed "offset collation" wherein sheets are concurrently collated, sorted and stacked to form collated, sorted and stacked sets into a receiving station, comprising the steps of:

feeding in sequence sheets of sets to be offset collated, wherein said sequence is defined as the feeding of the first sheet of each set to be offset collated, numbering up to and corresponding to said number of sets to be offset collated, and the subsequent feeding, in turn, of additional sheets, numbering up to and corresponding to the number of sheets in a set;

skewing, as referenced to a straight line sheet path, each sheet, in turn, in said sequence alternately and in opposite directions;

gripping in said sequence each oppositely skewed ones of said sheets;

transporting, in a predetermined transport path, and in said sequence, each oppositely skewed ones of said sheets;

alternately inserting and in said sequence, each oppositely skewed ones of said sheets contiguous to and upon the top of each other, into said receiving station, the skewing of said sheets alternately and in opposite directions clearly demarcating each said first sheet from adjacent first sheets in said sequence, and providing two oppositely projected corners, one of said corners corresponding to the odd numbered first sheets in said sequence, and the other one of said corners corresponding to the even numbered first sheets in said sequence;

lifting said corner corresponding to said odd numbered first sheets in said sequence;

inserting under said corner corresponding to said odd numbered first sheets in said sequence the next sheet in said sequence corresponding to the second sheet of the first set;

dropping said prior inserted first sheet, said first set onto said second sheet thereof;

lifting said corner corresponding to said even numbered first sheets in said sequence;

inserting under said corner corresponding to said even numbered first sheets in said sequence the next sheet in said sequence corresponding to the second sheet of the second set;

dropping said prior inserted first sheet of said second set onto said second sheet thereof;

continuing in said sequence, if required by the number of sets to be offset collated, the steps of lifting said corner corresponding to said odd numbered first sheets in said sequence, inserting under said corner corresponding to said odd numbered first sheets in said sequence the second sheet of the next odd numbered set, dropping said prior inserted first sheet of said next odd set onto said second sheet thereof, lifting said corner corresponding to said even numbered first sheets in said sequence, inserting under said corner corresponding to said even numbered first sheets in said sequence the second sheet of the next odd numbered set and dropping said prior inserted first sheet of said next even set onto said second sheet thereof; and repeating, if required by the number of sheets in said sets to be offset collated, the steps of lifting the corner corresponding to the odd numbered sets, inserting thereunder the next sheet in said sequence, dropping the prior inserted sheets of the next odd set in said sequence onto the prior inserted sheet of its set, lifting the corner corresponding to the even numbered sets, inserting thereunder the next sheet in said sequence and dropping the prior inserted sheets of the next even set in said sequence onto the prior inserted sheets of its set, thereby forming concurrently said collated, sorted and stacked sets.

17. The method according to claim 16 wherein said predetermined transport path is arcuate and runs to and through said receiving station.

18. Apparatus for collating sequentially supplied sheets into plural discrete sets in a "unibin" receiver, comprising:

offsetting means for engaging each of said sequentially supplied sheets and offsetting each sheet with respect to the immediately preceding sheet;

insertion means for sequentially inserting said offset sheets from said offsetting means in said "unibin" receiver to form a single stack with the sets being in face-to-face contact and for retaining said offset; and separation means at said "unibin" receiver for engaging said inserted offset sheets and separating differently offset adjacent sheets of said single stack for insertion by said insertion means of a further sequentially supplied offset sheet therebetween.

19. The apparatus of claim 18 for collating said sheets into a plurality "n" of sets of sheets, additionally comprising:

control means for controlling said offsetting means, said insertion means and said separation means for offsetting and inserting thereby a number of said sequentially supplied sheets equal to the number "n" of said plurality of sets of sheets; and for repetitively separating said inserted differently offset adjacent sheets of said single stack and offsetting and inserting a further said sequentially supplied and offset sheet therebetween, said offset being identical to that of one of said adjacent sheets, whereby said sheets both having the same offset and being contiguous comprise a set.

20. The apparatus of claim 19 wherein said separation means has a home position, and means for driving to said home position, and said control means is arranged to operate said separation means to drive to said home position during said offset and insertion of said number "n" of sheets, and upon each subsequent completion of said separation thereby during said offset and insertion of a number of said subsequently supplied sheets equal to said number "n".

21. The apparatus of claim 18 wherein said separation means engages said sheets at the portion thereof offset from an adjacent sheet offset therefrom.

22. The apparatus of claim 21 wherein said "unibin" receiver holds said sheets of said single stack horizontally; said insertion means inserts said sheets horizontally; and said separation means additionally supports said sheets for separating each said sheet from a sheet offset therefrom immediately thereunder.

23. The apparatus of claim 22 wherein said separation means additionally supports said engaged portion of said engaged sheet some distance above said offset sheet immediately thereunder, thereby separating said sheets.

24. The method of collating supplied sheets into a plural number of discrete sets comprising the steps of:

(1) stacking in a differently offset position from each adjacent sheet, all in a single stack, a number of said supplied sheets equal to the number of said discrete sets with the sets being in face-to-face contact;

(2) separating said differently offset adjacent sheets of said single stack;

(3) inserting a supplied sheet between each said separated differently offset adjacent sheets of said single stack and at one end of said stack, each inserted sheet offset identically to one of said adjacent sheets, the number of said inserted sheets being equal to the number of said discrete sets; and (4) repeating steps (2) and (3) until the last of said supplied sheets has been inserted, each group of adjacent said sheets having the identical offset comprising one of said discrete sets.

25. The method of claim 24 wherein:

said separating step comprises supporting a portion of one of each two said differently offset adjacent sheets of said single stack some distance from the other of said two sheets, said portion being the portion of said one sheet which is differently offset.

26. The method of collating of claim 24 wherein said separating step comprises:

engaging at least one of each two said differently offset adjacent sheets of said single stack at the portion thereof which is offset from the other sheet; and supporting at least said engaged portion of said one sheet at a point some distance from the other of said two sheets.

27. The method of collating of claim 24 wherein said supplied sheets are sequentially supplied and wherein:

said separating step comprises sequentially separating each said sheet offset from an adjacent sheet of said single stack; and said inserting step additionally comprises sequentially inserting said supplied sheets singly between each said sequentially separated differently offset adjacent sheets of said single stack and at one end of said stack.

28. The method of placing sequentially supplied sheets in a "unibin" receiver and forming plural discrete sets of said sheets comprising the steps of:

(1) offsetting each said sequentially supplied sheet with respect to the immediately preceding sheet;

(2) sequentially inserting said offset sheets in said "unibin" receiver in a single stack with the sets being in face-to-face contact and for retaining said offset;

(3) engaging at least one of two differently offset adjacent said inserted sheets of said single stack;

(4) separating said engaged sheet from said adjacent sheet;

(5) repeating steps (1) and (2) for inserting one of said sequentially supplied offset sheets between said engaged sheet and said adjacent sheet; and (6) controlling said offsetting step to identically offset said sheet to be inserted between said separated sheets as one of said separated sheets, whereby a group of adjacent said inserted sheets having the identical offset comprise one of said discrete sets.

29. The method of claim 28 for forming N discrete sets wherein:

said offsetting and sequentially inserting steps are initially conducted for N said sheets; and said engaging, separating, controlling, offsetting and sequentially inserting steps are conducted to insert thereby N said sheets, repetitively, until all of said sequentially supplied sheets have been inserted in said single stack in said "unibin" receiver.

30. A method of collating termed "offset collation" wherein sheets are concurrently collated, sorted and stacked to form a number of collated, sorted and stacked multisheet sets into a receiving station, comprising the steps of:

alternately inserting in an offset fashion contiguous to and upon the top of each other, into said receiving station, the first sheet of each set to be offset collated, numbering up to and corresponding to the number of sets to be offset collated, the offset clearly demarcating each said first sheet from adjacent first sheets;

alternately inserting in said offset fashion, into said receiving station, the second sheet of each set to be offset collated, numbering up to and corresponding to said number of sets to be offset collated, each of said second sheets being alternately inserted in said offset fashion contiguous to and on the bottom of each of said first sheets, including:

supporting the sheets received in said receiving station, while said sheets are in said offset fashion; and separating the sheets received in said receiving station while said sheets are in said offset fashion, such that said second sheets are alternately inserted contiguous to and on the bottom of each of said first sheets, and if required by the number of sheets in said sets to be offset collated, such that said additional sheets of each set are alternately inserted contiguous to and on the bottom of each of the prior inserted sheets of its set; and repeating, if required by the number of sheets in said number of sets to be offset collated, the step of alternately inserting, in turn, in said offset fashion, into said receiving station, additional sheets of each set to be offset collated, numbering up to and corresponding to said number of sets to be offset collated, each of said additional sheets of each set being alternately inserted contiguous to and on the bottom of each of the prior inserted sheets of its set, thereby forming concurrently said collated, sorted and stacked sets.

* * * * *